United States Patent [19]

Reinders

[11] 4,236,744

[45] Dec. 2, 1980

[54] GRIPPING-LIFTING APPARATUS

[75] Inventor: Jannes Reinders, Loppersum, Netherlands

[73] Assignee: Jannes Reinders & Noord-Nederlandache Machinefabriek B. V., Netherlands

[21] Appl. No.: 954,861

[22] Filed: Oct. 26, 1978

[30] Foreign Application Priority Data

Oct. 31, 1977 [NL] Netherlands ..... 7711930

[51] Int. Cl.[3] ..... B66C 1/42

[52] U.S. Cl. ..... 294/88

[58] Field of Search ..... 294/88, 111, 66 P, 66 R, 294/70, 71; 37/56, 71, 182, 183, 184, 185, 186, 187; 414/656, 657, 658

[56] References Cited

U.S. PATENT DOCUMENTS 2,906,555 9/1959 Heppenstall, Jr. ..... 294/88

4,143,900 3/1979 Longo ..... 294/88

*Primary Examiner*—James B. Marbert

*Attorney, Agent, or Firm*—Irvin A. Lavine

[57] ABSTRACT

An apparatus for hoisting a load, comprising a hoisting hook or eye to be coupled to a hoisting member, at least two oppositely positioned gripping arms with gripping jaws movable relative to each other, a connection of the hoisting eye via pulling members to the gripping arms for urging the gripping arms towards each other during the hoisting operation, whereby at least one pulling member is coupled to the one end of a first hydraulic piston-cylinder assembly provided with a resilient member for urging the first assembly in the starting position, and furthermore comprising a second hydraulic piston-cylinder assembly mechanically connected to one of the gripping arms and via a hydraulic line to the first hydraulic cylinder, resulting during the hoisting operation in the flow of the oil pressurized in the first cylinder towards the second cylinder and urging the gripping jaws towards each other, at least one non-return valve in the hydraulic line of the first cylinder to the second cylinder and an operable valve means for connection of the second cylinder to an oil collection space.

7 Claims, 1 Drawing Figure

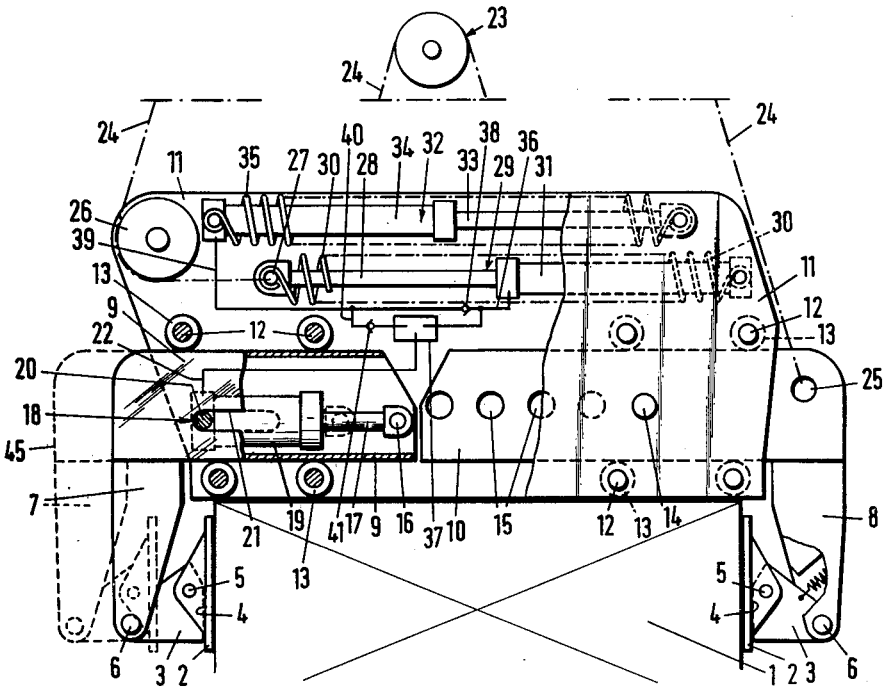
23
24
24
24
11
35
27
30
40
28
34
32
33
38
29
36
31
26
39
13
9
22
12
20
18
45
7
21
19
41
17
9
16
37
10
15
12
13
14
30
11
12
13
25
8
5
4
6
3
2
13
5
4
1
2
3
6

GRIPPING-LIFTING APPARATUS

The invention relates to an apparatus for lifting a load, comprising a load hook or eye to be coupled to a lifting means, such as a crane, at least two oppositely disposed gripping arms movable relatively to each other having gripping jaws for gripping the load, whereby the lifting eye is so connected via pulling members to the gripping arms that during the hoisting, the clamping arms are urged towards each other.

Such an apparatus is used e.g. for loading and unloading bags, tubes, paper coils and the like, during which the weight of the load is utilized for exerting the required clamping force. For instance it has already been proposed to design two clamping arms movable in telescopic relationship to each other, each clamping arm and lifting eye being provided with a rope sheave whereon runs a cable, which ends are connected to the two gripping arms. By exerting a hoisting force the two gripping arms are drawn towards each other. It is also known to use a linkage construction wherein the opposite ends of the arms of the link are provided at the one end of the pivot point with gripping jaws, while the arms disposed at the other side of the pivot point are provided with eyes through which extends a hoisting chain. During the hoisting operation said eyes will therefore be drawn together at the arms, so that the gripping jaws are clamped accordingly against the product to be hoisted.

A drawback of such an embodiment is that during the reduction of the hoisting force the clamping force is reduced accordingly.

It is the object of the invention to provide an improved apparatus of the above described type.

To this effect according to the invention at least one pulling member is coupled to the one end of a first hydraulic piston-cylinder assembly, provided with a resilient member adapted to urge the hydraulic piston-cylinder assembly to a starting position, while there is furthermore provided a second hydraulic piston-cylinder assembly which is so connected mechanically to one of the gripping arms, as well as via a hydraulic line to the first hydraulic cylinder that during the hoisting of the apparatus the oil pressurized in the first cylinder tends to flow towards the second cylinder, urging the gripping jaws towards each other, there being provided at least one non-return valve in the hydraulic line from the first to the second cylinder, as well as an operable valve means adapted for communication between the second cylinder and an oil collection space. In this manner the pressure generated in the first cylinder during the hoisting operation is transferred via the non-return valve in the second cylinder so that the two gripping jaws are urged towards each other. The non-return valve prevents the elimination of the gripping force after the hoisting force has dropped out. In order to selectively eliminate the gripping force yet, there is provided the operable valve member for the outflow of oil from the second cylinder. Although use may be made of an oil reservoir for compensating the volume variation in the cylinders, preferably the first and the second cylinder are so interconnected that during the elimination of the hoisting force and the resulting engagement of the release spring of the first piston-cylinder assembly, there is generated in the first cylinder a partial vacuum which during the operation of the valve member is active for returning the second cylinder to the starting position. Naturally it is also possible to provide the second piston-cylinder assembly with a release spring in order to return same to the starting position.

In accordance with another embodiment of the invention there is provided a third hydraulic piston-cylinder assembly which likewise is urged by a resilient member to a starting position, whereby there is provided a non-return valve in a hydraulic line from the first to the second cylinder, while furthermore the third cylinder is connected through a non-return valve to the second cylinder. During the hoisting of a load, oil will flow from the first cylinder to the second and the third cylinder. When the hoisting force drops out, under influence of the release spring of the third piston-cylinder assembly, oil will continue to flow from the third cylinder to the second cylinder, while maintaining sufficient pressure therein.

Preferably use is made thereby of a three-way cock in the connections between the three cylinders in such a way that in a position of the three-way cock the connection between the second cylinder and the first and third cylinder is completely cut off, whereby in a second or clamping position exclusively oil from the first or the third cylinder can flow to the second cylinder, while in a third or unloading position, there exists a free connection between the first and the second cylinder.

Preferably each gripping jaw is mounted on the gripping arm with interposition of a pivot arm in such a way that during the hoisting of a load the pivot point of the pivot arm with the gripping jaw is disposed above the corresponding pivot point of the pivot arm at the clamping arm, whereby there is mounted a stop on the pivot arm so that an excessive upward displacement of the pivot arm with gripping jaw relative to the gripping arm is avoided. During the hoisting the weight of the load will tend to pull the gripping jaws downwardly. Due to the double-pivoting arm there will thus be exerted an additional gripping effect.

Further particulars will also appear from the following description of an embodiment according to the invention.

The single FIGURE of the drawing diagrammatically shows a hoisting apparatus according to the invention, wherein 1 indicates a load to be hoisted, e.g. a paper bag to be hoisted. This load is clamped by means of two gripping jaws 2, the shape of which may be adapted to that of the load, e.g. of circular cross section when a round bag has to be hoisted. Each gripping jaw 2 is pivotally mounted on a pivoting arm 3 which at 4 comes in engagement with the gripping jaw. The pivoting arms 3 are on the one end connected at 5 pivotally to the gripping jaw and on the other end at 6 pivotally connected to respectively a left gripping arm 7 and a right gripping arm 8. Said gripping arms are integral with horizontal tubular guide pieces 9, respecitively 10. Said tubular pieces 9 and 10 are incorporated in a frame generally indicated by 11. This comprises in the example two parallel web plates which are interconnected by a plurality of connection bolts 12 whereon are mounted rollers 13. Between said rollers 13 the tubular pieces 9 and 10 can be horizontally reciprocated. The right gripping arm 8 with tubular piece 10 is secured relative to the frame 11 by means of a lock pin 14. In the tubular piece 10 there are applied a plurality of holes 15 for securing the right-hand or fixed gripping arm 8 in another position adapted to the diameter or width of the product to be hoisted. The left-hand or movable gripping arm 7 is connected at 16 to the piston rod 17 of a hydraulic piston-cylinder assembly indicated in general by 18. This assembly is indicated in the above as second hydraulic piston-cylinder assembly. The end of the hydraulic cylinder 19 is secured with a pin 20 to the frame 11. Said pin 20, or possibly more attachment portions, extends through an elongated recess 21 indicated partly by broken lines in the tubular member 9.

By conducting via a line 22 oil to the hydraulic cylinder 19, the piston rod 17 with tubular member 9 in the FIGURE is urged to the right, thus activating the gripping apparatus. In the FIGURE the outer gripping position is indicated.

The hoisting apparatus is provided at the top with a lifting eye 23. This lifting eye is provided with a rope sheave on which runs a rope 24 as pulling member. Said rope 24 is secured at 25 to the right gripping arm 8. The left part of the pulling rope runs via a rope sheave 26 in the frame 11 and is connected to the eye 27 of a piston rod 28 of a first, see above, hydraulic piston-cylinder assembly 29. This assembly 29 is provided with a tension spring 30 adapted to urge the piston rod in the completely retracted position in cylinder 31. Furthermore the embodiment shows a third hydraulic piston-cylinder assembly generally indicated by 32 and having a piston rod 33, a hydraulic cylinder 34 and a tension spring 35 adapted to maintain said hydraulic piston-cylinder assembly likewise in the retracted position.

The first piston-cylinder assembly 29 is connected via a line 36 to a three-way cock 37 and via a non-return valve 38 to the cylinder space underneath the piston in the piston-cylinder assembly 32 by means of a line 39. In said line 39 there is provided a branch 40 which is connected via a non-return valve 41 to another inlet of the three-way cock 37. Furthermore there is connected to said three-way cock the line 22 to the cylinder assembly 17.

Prior to taking up a load, the left gripping arm 7 is in the position 45 indicated by broken lines. The apparatus is then lowered onto the load 1, thereby adapting if necessary by means of pin 14 the position of the right gripping arm 8 to the width or the diameter of the load to be hoisted. At this moment there is no tension in the rope 24, so that under influence of spring 30 the piston-cylinder assembly 29 will be urged towards the retracted position. Above the piston in cylinder 31, i.e. at the left-hand side of the piston, not shown, in said cylinder there will thereby prevail a partial vacuum. By bringing the three-way cock 37 in the right-hand position, line 22 will be connected to line 36. The partial vacuum in cylinder 31 will exert its influence through line 22 into cylinder 19 whereby the assembly 18 will likewise be drawn to its retracted position while the gripping arm will occupy the position indicated by 45. Prior to starting the hoisting operation, the three-way cock 37 will be brought in the left position, i.e. the line 22 is throughconnected to line 40. Insofar the third piston-cylinder assembly 32 has not yet attained the completely retracted position, oil, under influence of the spring 35, will flow from cylinder 34 via lines 39 and 40, non-return valve 4, three-way cock 37 and via line 22 to the cylinder 19, as a result of which the piston rod 17 thereof will be protracted while the gripping arm 7 will be pressed to the right in the FIGURE to against the load 1 to be hoisted.

However it is possible that the piston-cylinder assembly 32 has attained its retracted position, so that no or insufficient quantity of oil is available for extending the second piston-cylinder assembly 18. During the hoisting operation the pulling rope 24 will be tensioned, so that the piston rod 28 is drawn via connection 27 to the protracted position. The spring 30 is thereby so dimensioned that the weight of the apparatus proper is sufficiently large to overcome the force thereof, at least initially. As a result oil will be pressed to the clamping cylinder 19 via line 36, non-return valve 38, line 40, non-return valve 41 and via the three-way cock 37 and line 22, so that a certain degree of clamping is effected. This oil pressure need not be sufficient yet to protract the piston rod 33 against the action of spring 35. However as soon as the weight of the apparatus proper has been overcome, a greater force in rope 24 of the hoisting apparatus will be active under influence of the weight of the load 1. As a result a greater force will be transmitted from the piston-cylinder assembly 29 to the clamping cylinder 19, so that the load will be clamped with a greater force, depending on the weight of the load. Thereby the force of the spring 35 will likewise be overcome to an increasing extent and said spring will be extended and tensioned.

Should the force in the rope 22 decrease, possibly to zero, e.g. in that the load impinges an obstacle or is put down, then the piston rod 28 will be retracted under influence of spring 30 until a partial vacuum at the left side of the piston in cylinder 29 is in equilibrium with the force of spring 30. Due to the activity of the non-return valve 38 and the connection between lines 36 and 22 blocked by the three-way cock 36, this will have no further influence on the clamping force of the arms of the apparatus. Even when for some reason no pressure can be supplied any longer from the third piston-cylinder assembly 32 e.g. in that the spring 35 has completely retracted the piston rod 33, the clamping cylinder 19 will still be active due to the activity of the non-return valve 41. In this manner it is reliably prevented that for some reason the clamping apparatus becomes unwillingly inactive. After positioning of a load, the three-way cock 37 can be brought in the righ-hand position, whereby the line 22 is throughconnected to line 36. Insofar then no pressure or partial vacuum prevails in the cylinder 31, oil will be drawn away from the clamping cylinder 19, so that the clamping arm 7 will be moved to the left, as a result of which the clamping apparatus releases the load.

To prevent that during displacement of the apparatus from a load to another one, the clamping cylinder 19 becomes active, thereby urging the clamping arm 7 to the right, the three-way cock 37 can be set in the mid-position, whereby the lines communicating with said cock are not throughconnected. During the hoisting operation there will be produced though a pressure in cylinder 31 of the assembly 29 and possibly in that of assembly 32, in accordance with the weight of the apparatus proper, but the clamping arm 7 will continue to occupy its released position, as indicated by 45. After the lowering of the apparatus on a load 1, it is possible by moving the three-way cock 37 to the left-hand position, to effect the clamping under influence of the possibly more or less protracted piston-cylinder assembly 32 and/or through the operation during hoisting of the piston-cylinder assembly 29 as indicated in the above.

It is observed that instead of using a partial vacuum in the piston-cylinder assembly 29 for bringing the clamping arm 7 in the released position, also the clamping cylinder 19 may be provided with a release spring. In such an embodiment it is also possible to connect the cylinder 31 of the piston-cylinder assembly 29 via a non-return valve to a storage reservoir so that during the pressing of piston rod 28 in the cylinder 31 oil will be drawn into said cylinder. Naturally the three-way cock 37 should then be so designed that oil, if desired, can flow back from line 22 to the reservoir.

It is observed yet that, if desired, the three-way cock 37 may be remote-controlled, e.g. mechanically, electrically or pneumatically. This operation may take place both from the crane and from a position adjacent the hoisting apparatus.

The pivot point 5 in the clamping position is disposed slightly higher than the pivot point 6. During the hoisting of a load, whereby a vertical force is acting on the gripping jaws, the pivot points of the two gripping jaws will be subjected both to a vertical and to a horizontal movement towards each other. The resulting additional horizontal force increases the gripping force on the load. The position of the gripping jaw 2 relative to the associated pivoting arm 3 is determined by the stop 4. Possibly the pivoting arm 3, when no load is present, may be retained approximately in the position as shown, e.g. by means of a spring.

What I claim is:

1. An apparatus for hoisting a load comprising:

a hoisting hook, a frame, at least two gripping arms mounted on the frame and each having a gripping jaw for gripping a load between them, means for mounting at least one said gripping arm on the frame for movement relative to the other gripping arm, means connecting the hoisting hook to said gripping arms for causing movement of said gripping jaws towards each other during hoisting movement of said hoisting hook comprising:

a first hydraulic piston-cylinder assembly mounted on the frame and having resilient means for urging the piston thereof to a retracted position, a second hydraulic piston-cylinder assembly mounted on the frame and comprising means for actuating the movably mounted gripping arm, means connecting said hoisting hook and said first assembly for extending said first assembly upon hoisting movement of said hoisting hook, and hydraulic means for connecting said first and second assemblies.

2. The apparatus of claim 1, and further comprising a third hydraulic piston-cylinder assembly mounted on the frame and having resilient means for urging the piston thereof to a retracted position, said hydraulic means comprising means for connecting said third assembly to said first and second assemblies.

3. The apparatus of claim 2, said hydraulic means comprising a three-way valve for connecting said second assembly to either said first or said third assemblies, or for closing communication to said second assembly.

4. The apparatus of claim 3, said hydraulic means further comprising a non-return valve permitting flow from said third assembly to said three way valve.

5. The apparatus of claim 3, said hydraulic means further comprising a by-pass line in parallel with said three way valve communicating said first and third assemblies, and a non-return valve in said by-pass line permitting flow from said first assembly.

6. The apparatus of claim 1, wherein each said gripping arm has a vertically depending portion, a pivoting arm horizontally pivotally connected at the lower end thereof, and the gripping jaw horizontally pivotally connected to the pivoting arm, at a level above the pivotal connection of the pivoting arm and the gripping arm during hoisting movement.

7. The apparatus of claim 6, and stop means for each said jaw to prevent excessive movement thereof relative to the pivoting arm.

* * * * *